US005646656A

United States Patent [19]

Leonhardt et al.

[11] Patent Number: 5,646,656

[45] Date of Patent: Jul. 8, 1997

[54] INK-JET PRINTING DEVICE AND METHOD

[75] Inventors: Holger Leonhardt, Bammental; Tobias Müller, Hirschberg; Roland Pudimat, Eberbach, all of Germany

[73] Assignee: Heidelberger Druckmaschinen AG, Heidelberg, Germany

[21] Appl. No.: 387,598

[22] Filed: Feb. 13, 1995

[30] Foreign Application Priority Data

Feb. 12, 1994 [DE] Germany ..... 44 04 557.3

[51] Int. Cl.[6] ..... B41J 2/21; B41J 29/38

[52] U.S. Cl. ..... 347/43; 347/6

[58] Field of Search ..... 347/43, 74, 85, 347/75, 7, 118, 6

[56] References Cited

U.S. PATENT DOCUMENTS

| | | | |
|---|---|---|---|
| 3,601,589 | 8/1971 | McCarty . | |
| 4,087,825 | 5/1978 | Chen et al. . | |
| 4,614,953 | 9/1986 | Lapeyre . | |
| 4,670,780 | 6/1987 | McManus et al. . | |
| 4,741,930 | 5/1988 | Howard et al. . | |
| 5,371,529 | 12/1994 | Eguchi et al. | 347/7 |

FOREIGN PATENT DOCUMENTS

| | | |
|---|---|---|
| 0282446 | 4/1991 | European Pat. Off. . |
| 0446168 | 9/1991 | European Pat. Off. . |
| 2551689 | 5/1977 | Germany . |
| 3007421 | 9/1981 | Germany . |
| 3207369 | 12/1991 | Germany . |
| 60-225759 | 11/1994 | Japan . |
| 55-159980 | 11/1994 | Japan . |
| 3-83653 | 11/1994 | Japan . |
| 1563118 | 3/1980 | United Kingdom . |
| 2071573 | 9/1981 | United Kingdom . |

*Primary Examiner*—Benjamin R. Fuller
*Assistant Examiner*—Thinh Nguyen
*Attorney, Agent, or Firm*—Herbert L. Lerner; Laurence A. Greenberg

[57] ABSTRACT

Ink-jet printer includes a device for supplying ink, an ink-jet generating device connected thereto, the ink-jet generating device having at least one nozzle for selectively applying ink to a recording carrier or a print transferring material and being positionable relative to the recording carrier or the print transferring material, and a control device to which the ink-jet generating device is connected, the ink-supplying device having at least one mixing chamber for inks of different colors, the mixing chamber having ink inlet channels thereto formed with respective inlet openings, and respective metering devices for the inlet openings disposed in the ink inlet channels, the metering devices being connected to the control device and being actuatable thereby; and method of operation.

20 Claims, 5 Drawing Sheets

INK-JET PRINTING DEVICE AND METHOD

BACKGROUND OF THE INVENTION

Field of the Invention

The invention relates to an ink-jet printing device or printer and an ink-jet printing method. In accordance with the so-called three-color theory, all color tones or tints of an image are mixtures of the ideal additive basic colors red, green and blue and of the ideal subtractive basic colors cyan, magenta and yellow, respectively. A subjective color impression is formed depending upon the light, the recording carrier and the visual system of the observer.

It has become known heretofore with respect to ink-jet printers, to apply the three basic colors cyan, magenta and yellow, as well as the printing ink black to a recording carrier, usually white paper. To produce half-tone images, the basic colors are applied in the form of dots. When the dots are covered, subtractive color mixing to red, green and black occurs. The subjective color impression results from additive mixing of the dots and mutually adjacent color areas cyan, magenta, yellow, red, green, blue, white and black, respectively. The dots are applied selectively to a recording carrier or a print transfer material by means of a device for producing an ink jet. Additionally provided therewith are one or more printing heads with at least one nozzle for each color which is to be printed. The printing heads are operatively connected with devices for supplying ink and are disposed so as to be displaceable relative to the recording carrier or print transfer material.

SUMMARY OF THE INVENTION

It is an object of the invention to provide an ink-jet printing method and an ink-jet printer which is improved over those heretofore known and which, in one pass, produce a multicolor image with transparent or opaque inks on a recording carrier or a print transfer material.

With the foregoing and other objects in view, there is provided, in accordance with the invention, an ink-jet printer comprising a device for supplying ink, an ink-jet generating device connected thereto, the ink-jet generating device having at least one nozzle for selectively applying ink to a recording carrier or a print transferring material and being positionable relative to the recording carrier or the print transferring material, and control means to which the ink-jet generating device is connected, the ink-supplying device having at least one mixing chamber for inks of different colors, the mixing chamber having ink inlet channels thereto formed with respective inlet openings, and respective metering devices for the inlet openings disposed in the ink inlet channels, the metering devices being connected to the control means and being actuatable thereby.

In accordance with another feature of the invention, the ink-jet printer includes an input device for digitized image data, a device for monitoring at least one of ink color and quality, an ink collecting vessel and a deflection device for controlling the ink-jet into the ink collecting vessel, a device for measuring color location and moisture of the recording carrier or print transfer material and a device connected with the mixing chamber for removing incorrect ink mixtures from the mixing chamber, the control means being connected to at least one of the input device, the monitoring device, the deflection device, the measuring device and the ink-mixture removing device.

In accordance with a further feature of the invention, the monitoring device has ink measuring devices assigned to at least one of the ink inlet channels, the mixing chamber and the respective recording carrier or print transfer material.

In accordance with an added feature of the invention, the ink-supplying device and the ink-jet generating device are structurally united in a chamber.

In accordance with an additional feature of the invention, the mixing chamber is furnished with a homogeneous mixing device.

In accordance with yet another feature of the invention, the ink-jet printer includes a connecting channel between the mixing channel and the ink-jet generating device, and a device for introducing a separating medium disposed in the connecting channel.

In accordance with another aspect of the invention, there is provided an improvement in an ink-jet printing method which comprises, before selectively applying ink to a recording carrier or print transfer material, mixing inks of varying colors for a given half-tone dot to be produced.

In accordance with another mode of the ink-jet printing method of the invention, the method includes adjusting a mixing ratio of the inks in accordance with measurement signals from individual color measurements of the inks.

In accordance with a first alternative mode, the ink-jet printing method includes adjusting a mixed ratio of the inks in accordance with measurement signals from color measurements of preceding ink mixtures.

In accordance with a second alternative mode, the Ink-jet printing method includes adjusting a mixed ratio of the inks in accordance with measurement signals from color measurements of preceding incorrect or faulty mixtures.

In accordance with a third alternative mode, the ink-jet printing method includes adjusting a mixed ratio of the inks in accordance with measurement signals from color measurements on the recording carrier or print transfer material.

In accordance with a further mode, the ink-jet printing method of the invention includes adjusting the quantity of inks to be mixed in accordance with the physical properties or characteristics of the recording carrier or print transfer material.

In accordance with an added mode, the ink-jet printing method includes further adjusting the quantity of the inks to be mixed in accordance with measurements of moisture and suction capacity of the recording carrier or the print transfer material.

In accordance with a further aspect of the invention, there is provided an improvement in an ink-jet printing method, which comprises, before selectively applying ink to a recording carrier or print transfer material, mixing inks of varying colors together with additives for a given half-tone dot to be produced.

In accordance with a concomitant mode, the ink-jet printing method comprises intermixing the additives in the form of at least one substance selected from the group consisting of adhesive agents and hardeners with the inks of varying colors.

Thus, the invention calls for mixing in a mixing chamber inks of varying colors and additives for exactly one half-tone dot to be produced, before selectively applying ink and additives to a recording carrier or print transfer material The inks may be used in the form of liquids, or other flowable substances, and producing transparent or opaque colored half-tone dots in accordance with the subtractive or additive methods noted hereinbefore. With the use of opaque inks, the color impression is most extensively independent of the color of the printing material or stock.

The invention permits more than a quadruple increase in the resolution with respect to conventional ink-jet methods.

The device of the invention for performing the method of the invention can produce anew the color for each dot with the aid of the control device.

Other features which are considered as characteristic for the invention are set forth in the appended claims.

Although the invention is illustrated and described herein as embodied in an ink-jet printing method and an ink-jet printing device or printer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
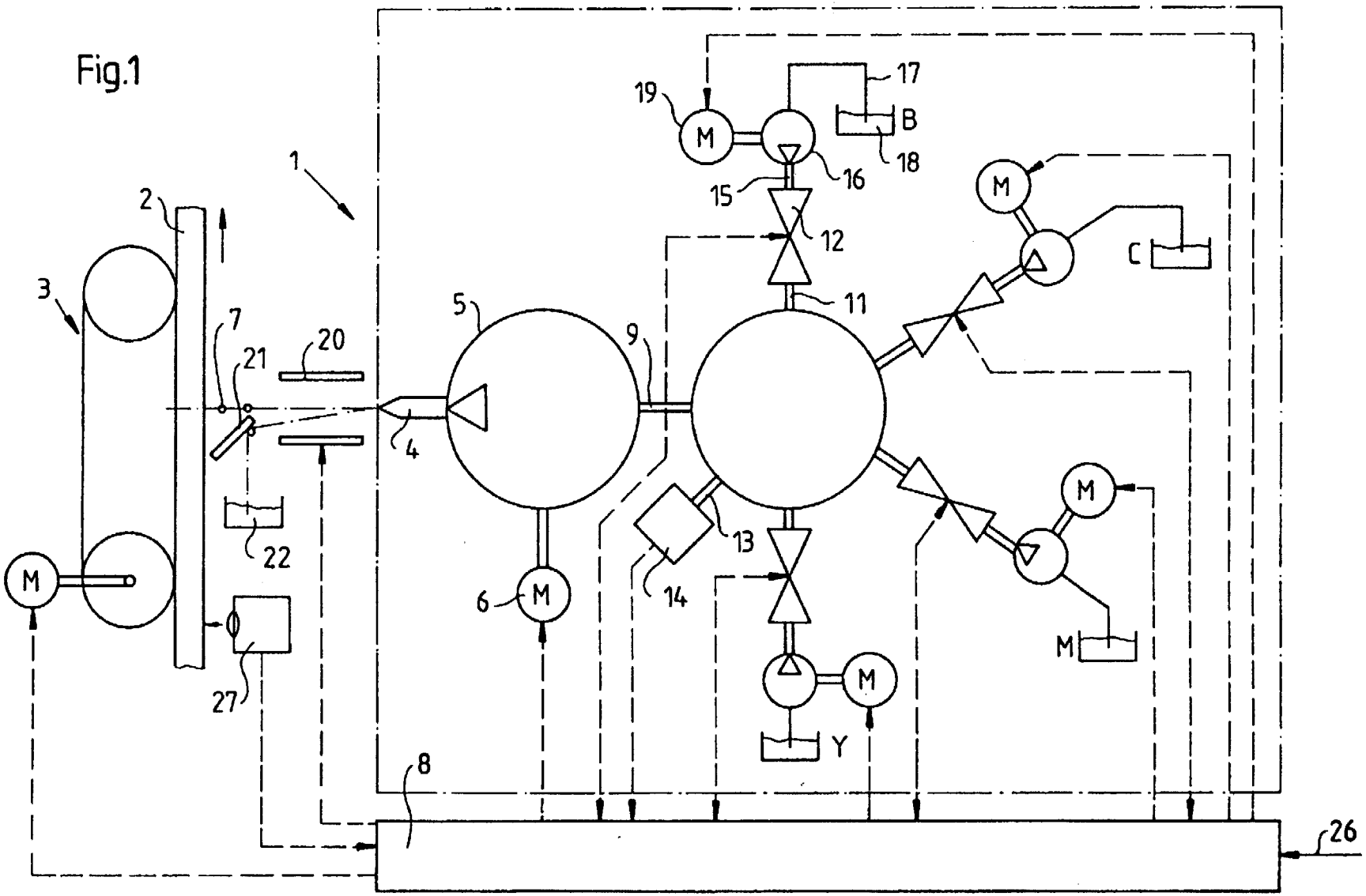
FIG. 1 is a schematic diagram of a first embodiment of an ink-jet printer or printing device constructed in accordance with the invention.

Referring now to the drawings and, first, particularly to FIG. 1 thereof, there is shown therein, in a schematic diagram, an ink-jet printer according to the invention, which includes a printing head 1 past which a recording carrier 2 is guided by a recording-carrier feeding device 3. It is also possible for the printing head 1 to be guided past a stationary recording carrier 2. The printing head 1 has a nozzle 4 for selectively applying ink to the surface of the recording carrier 2. The nozzle 4 is connected with an ink-jet generator 5 which acts as a liquid pump and is driven by a motor 6. A discrete or continual stream of ink droplets 7 or ink particles or an ink fog is formed at the outlet of the nozzle 4 and is applied to the recording carrier 2. The formation of the ink jet is not limited to the embodiment having an electric pump motor which is illustrated in FIG. 1. The ink jet may also be generated by vibrations, pressure, heat or by an electrical or magnetic field. In every case, the ink jet is generated on demand, i.e., whenever a signal to emit or release an ink jet is given to the motor 6 by a suitable control or regulating device 8. The ink-jet generator 5 has a volume equal to that of a mixing chamber 10 connected thereto via an outlet or exhaust channel 9. The mixing chamber 10 furthermore has at least four inlet channels 11 which are connected, respectively, with shutoff devices 12. The mixing chamber 10 is connected with a color measuring device 14 for the mixed inks via an inspection channel 13. The color measuring device 14 transmits color signals to the control and regulating device 8. The shutoff devices 12 are further connected via channels 15 with pumps 16 having suction lines 17 which terminate in ink supply containers 18. The ink supply containers 18 contain inks of the printing colors black, cyan, magenta and yellow. Each of the pumps 16, respectively, is driven by a motor 19, various pumping methods being applicable in this regard, as has been mentioned hereinbefore with respect to the ink-jet generator 5. Omitting the motors 19 and the pumps 16, it is also possible to fill the mixing chamber 10, inasmuch as negative pressure or vacuum is produced therein, a fact which is not represented in FIG. 1. It is essential only that a color mixture be produced in the mixing chamber 10 that is necessary for the next half-tone dot to be applied to the recording carrier 2. This purpose is served by the shutoff devices 12 which are connected bi-directionally with the control or regulating device 8. The amount of ink (black, cyan, magenta and yellow) to be introduced into the mixing chamber 10 can be determined by controlling the rate of flow through the shutoff device 12. The shutoff devices 12 may be provided with devices for measuring the flow rate therethrough, which transmit suitable signals regarding the rate or quantity of flow to the control or regulating device 8. The motors 19 are likewise connected with the control or regulating device 8 so that, as required, they can be set into operation. The color measuring device 14 serves for monitoring the color quality. If the color mixture in the mixing chamber 10, just before the application to the recording carrier 2, does not have the color which is supposed to be provided, a signal is transmitted via the control or regulating device 8 to a deflection device 20 which deflects the jet in a direction towards a deflection plate 21 by which the jet is reflected into a collecting vessel 22.

Figure 2:
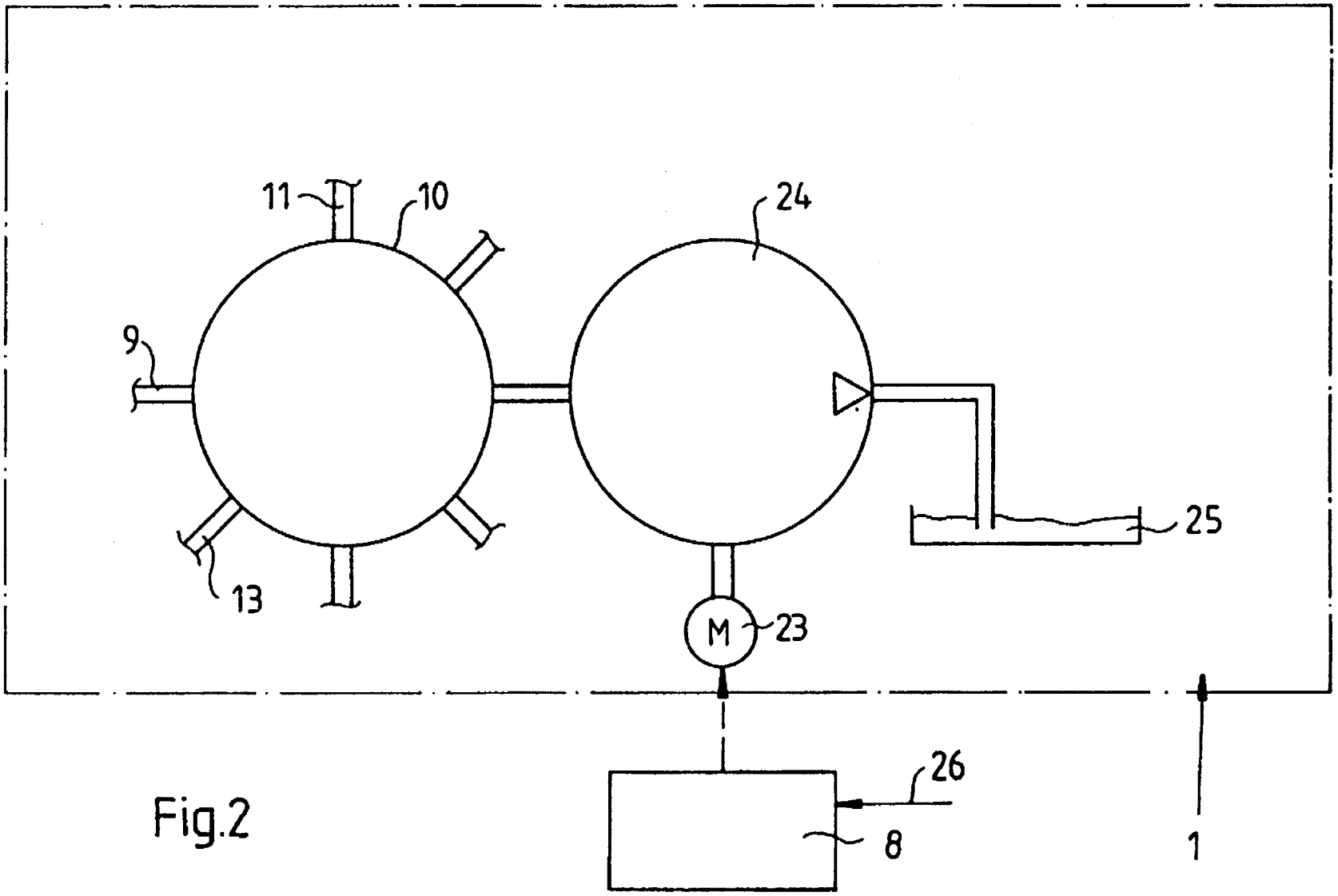
FIG. 2 is a schematic diagram of a second embodiment of the ink-jet printer with an exhaustion or suction removal device for incorrect ink mixtures.

A further possible construction for removing incorrect or faulty color mixtures from the mixing chamber is provided in the embodiment of FIG. 2, wherein the ink mixture is exhausted by a pump 24 driven by a motor 23 and discharged into a collecting vessel 25 which is mounted in the printing head 1.

The mixing ratio of the inks in the mixing chamber 10 is determined from the various parameter signals which are inputted to the control and regulating device 8. Via an input location 26 for coordinate-dependent image data, the nominal or setpoint signals for the next half-tone, which is supposed to be produced on the recording carrier 2 by means of the ink-jet generator 5 from the mixed inks in the mixing chamber 10, are fed to the control or regulating device 8. The control or regulating device 8 evaluates the signals to the physical properties or characteristics of the recording carrier 2 which are present therein or which are evaluated by means of a measuring head 27 (FIG. 1) just before the printing operation takes place. The measuring head 27 can transmit the signals describing the properties or characteristics of the recording carrier 2, in addition to the color of the recording carrier 2, the dampness and the amount of suction, among others, to the control or regulating device 8.

Figure 3:
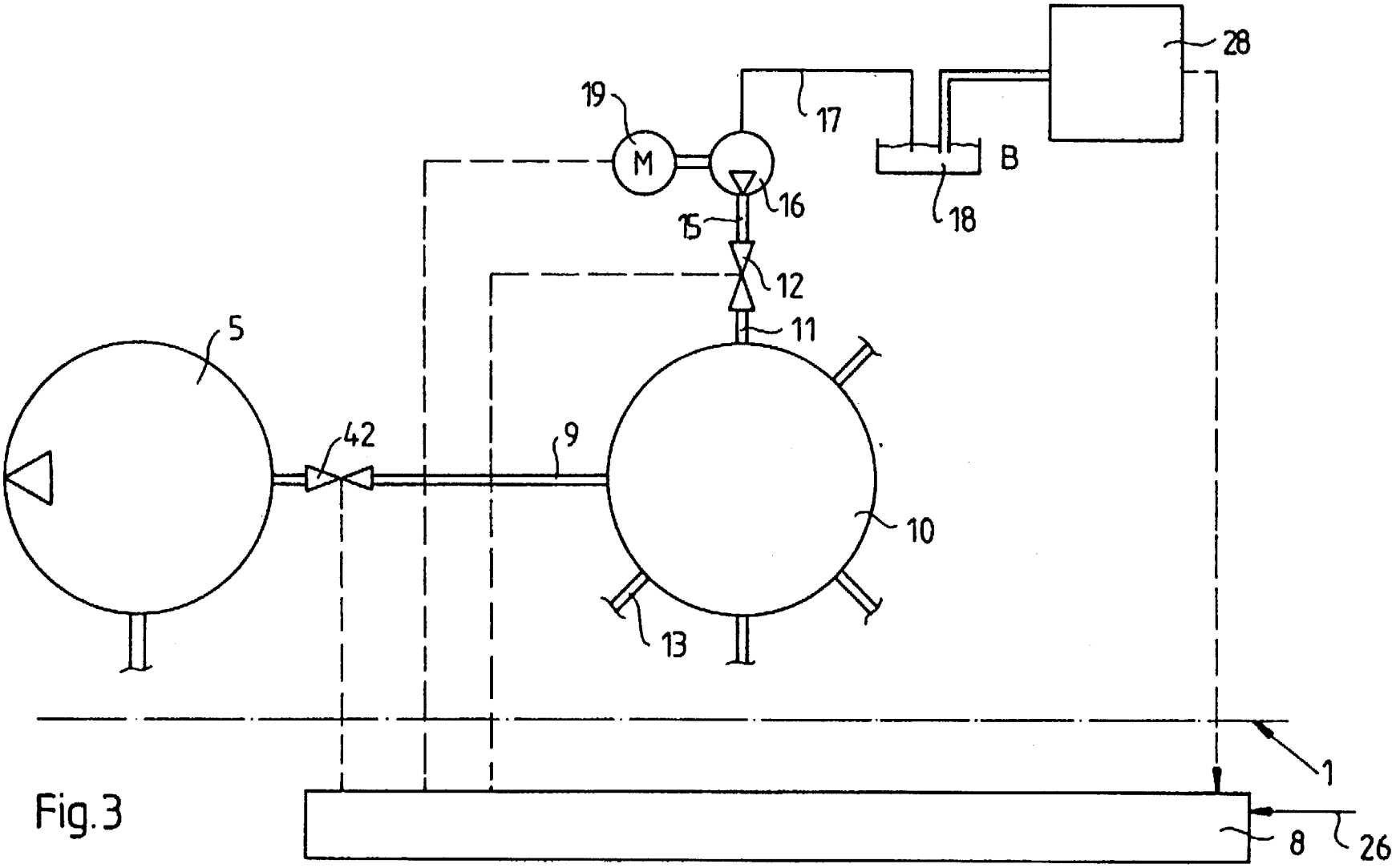
FIG. 3 is a schematic diagram of a third embodiment of the ink-jet printer with color measuring devices in ink supply containers therefor.

As represented in FIG. 3, further input values for the ink mixture can be produced by means of devices 28 for monitoring the ink quality which are directly associated with or assigned to the ink supply containers 18 and connected with the control or regulating device 8.

After a successful application of a half-tone dot to the recording carrier 2, the deflection device 20 or the recording carrier feeder 3 can be controlled to provide the location for the half-tone dot which is to be applied next.

Figure 4:
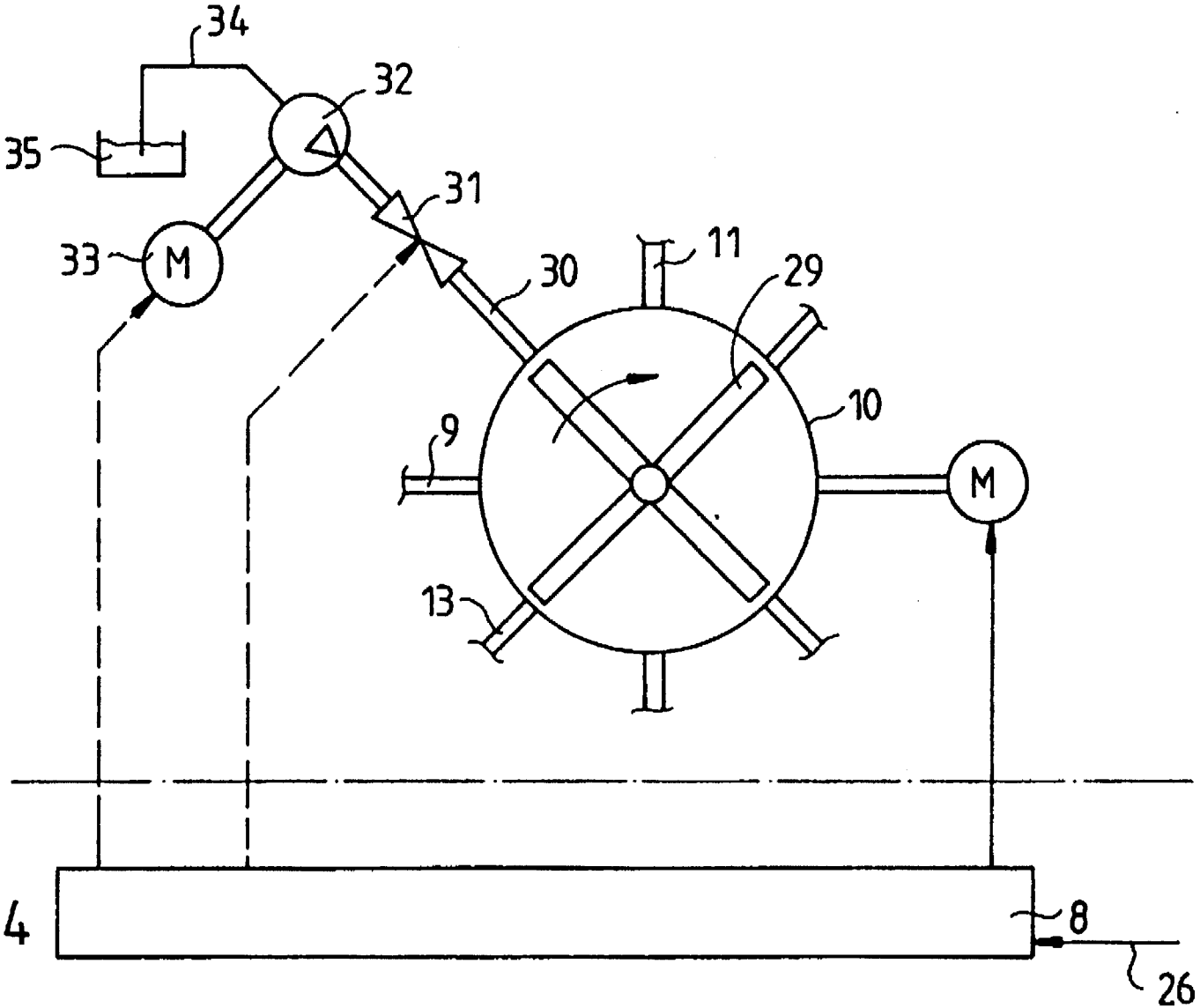
FIG. 4 is a schematic diagram of a fourth embodiment of the ink-jet printer with a mixing wheel in a mixing chamber thereof and a device for introducing additives.

In FIG. 4, a further embodiment is illustrated wherein a mixing wheel 29 is provided in the mixing chamber 10 and is supposed to effect a homogeneous mixing of the inks. Alternatively to the mixing wheel 29, other devices may be provided performing the mixing.

The mixing chamber 10 can have additional inlet channels 30 via which, by means of a metering valve 31 and a pump 32 with a motor 33, additives such as hardeners and adhesive agents can be admixed in addition to the four printing colors cyan, magenta, yellow and black. The additives are taken from a supply container 35 by means of a suction line 34.

Figure 5:
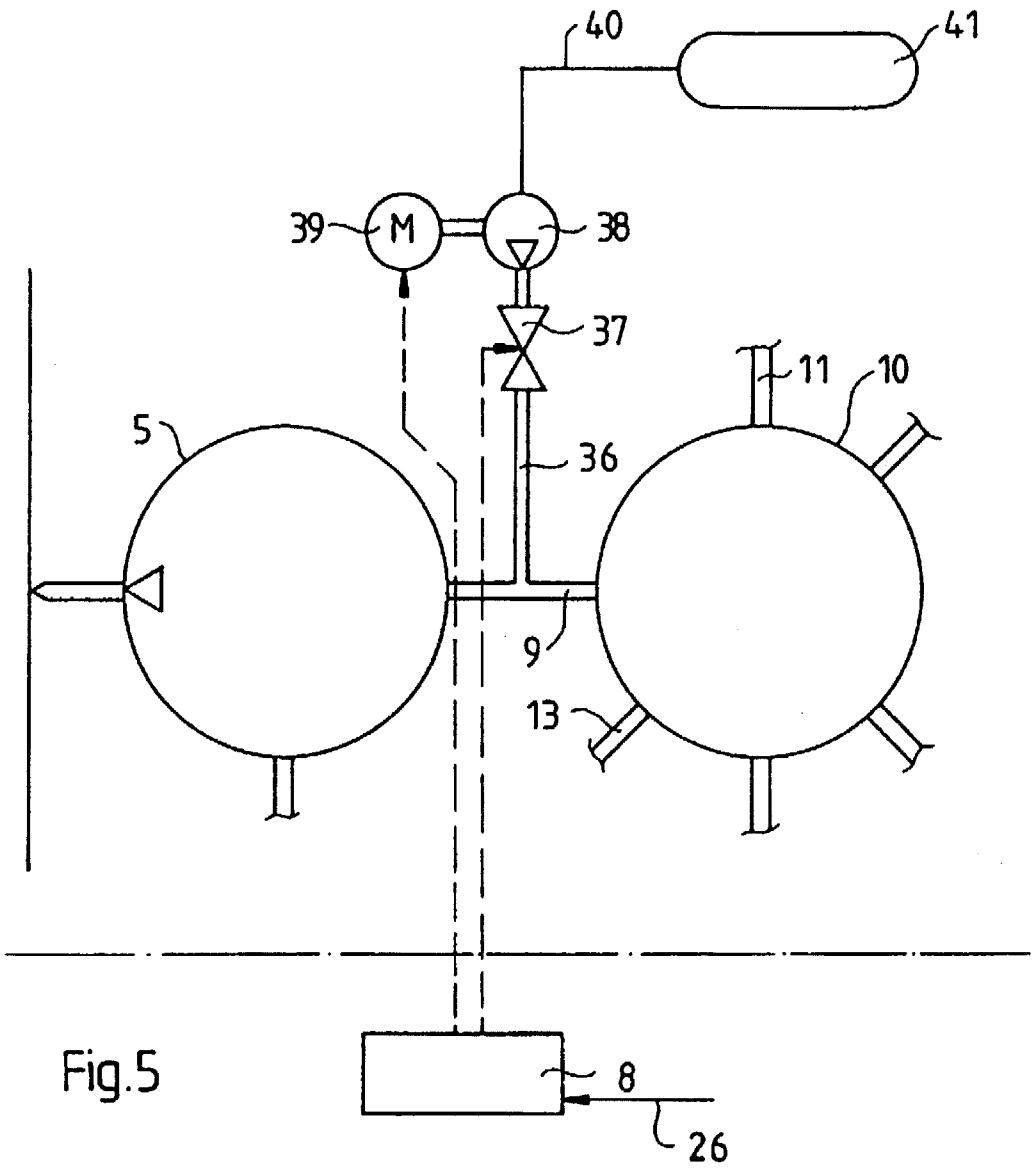
FIG. 5 is a schematic diagram of a fifth embodiment of the ink-jet printer with a device for introducing a separating medium into an exhaust or outlet channel of the printer.

As shown in FIG. 5, a branch 36 may be provided in the outlet or exhaust channel 9, via which and through a valve 37, a pump 38, a motor 39 and a line 40, a gaseous separating medium taken from a gas container or tank 41 is fed.

If necessary, at least an additional valve 42 (FIG. 3) can be disposed between the ink-jet generator 5 and the mixing chamber 10, by means of which a separation of the ink-jet generator 5 and the mixing chamber 10 can be achieved in order to be able to build up varying pressure ratios or relationships.

A non-illustrated embodiment which is conceivable is one wherein the ink-jet generator 5 and the mixing chamber 10 are one and the same, i.e., no separate mixing chamber is provided.

A further specialty or characteristic results if the ink transfer occurs during the operating cycle, several premixing chambers being able to be provided.

In a configuration with a mixing chamber 10 and a device 5 for generating the ink-jet, the ink-jet printer can be driven in a so-called three-cycle operation. In a first cycle, the mixing chamber 10 is then filled with the inks cyan, magenta, yellow and black to be mixed and, possibly, additives. In the second cycle, the mixed ink is transferred from the mixing chamber 10 into the device 5 for generating the ink-jet. And in a third cycle, the ink-jet generating device is actuated so that a half-tone dot is produced on the recording carrier 2.

In a configuration with a mixing chamber 10, an ink-jet generating device 5 and a device 36, 37, 38, 39, 40 for introducing a separating medium 41 into the outlet or exhaust channel 9 of the mixing chamber 10, the cycled operation can be performed so that, in a first cycle, the mixing chamber 10 is filled and the separating medium 41 is introduced into the outlet or exhaust channel 9 simultaneously. In a second cycle, the ink mixture is transferred from the mixing chamber 10 into the ink-jet generating device 5, the feeding of the separating medium having been interrupted therebefore. A pressure increase in the ink-jet generating device 5 causes the ink quantity conveyed in the preceding cycle into the ink-jet generating device 5 to be ejected in a direction towards the recording carrier 2.

The foregoing is a description corresponding in substance to German Application P 44 04 557.3, dated Feb. 2, 1994, the International priority of which is being claimed for the instant application, and which is hereby made part of this application. Any material discrepancies between the foregoing specification and the aforementioned corresponding German application are to be resolved in favor of the latter.

We claim:

1. Ink-jet printer comprising a device for supplying ink, an ink-jet generating device connected thereto, said ink-jet generating device having at least one nozzle for selectively applying ink to a recording carrier or a print transferring material and being positionable relative to the recording carrier or the print transferring material, and control means to which said ink-jet generating device is connected, said ink-supplying device having at least one mixing chamber for inks of different colors, said mixing chamber having ink inlet channels thereto forged with respective inlet openings, and respective metering devices for said inlet openings disposed in said ink inlet channels, said metering devices being connected to said control means and being actuatable thereby, and a device for monitoring ink color of said mixing chamber, said monitoring device being connected to said control means.

2. Ink-jet printer according to claim 1, including an input device for digitized image data, an ink collecting vessel and a deflection device for controlling the ink-jet into said ink collecting vessel, a device for measuring a color and moisture of the recording carrier or print transfer material and a device connected with said mixing chamber for removing incorrect ink mixtures from the mixing chamber, said control means being connected to at least one of said input device, said monitoring device, said deflection device, said measuring device and said ink mixture removing device.

3. Ink-jet printer according to claim 2, wherein said monitoring device has ink measuring devices disposed at at least one of said ink inlet channels, said mixing chamber and said recording carrier or print transfer material.

4. Ink-jet printer according to claim 1, wherein said ink-supplying device and said ink-jet generating device are structurally united in a chamber.

5. Ink-jet printer according to claim 1, wherein said mixing chamber is furnished with a homogeneous mixing device.

6. Ink-jet printer according to claim 1, including a connecting channel between said mixing channel and said ink-jet generating device, and a device for introducing a separating medium disposed in said connecting channel.

7. An ink-jet printing method, of the type in which half-tone dots are produced by selectively applying ink to a recording carrier or print transfer material, the method which comprises the steps of, before selectively applying ink to a recording carrier or print transfer material, mixing inks of a plurality of colors for a given half-tone dot to be produced, measuring a color of the ink during the mixing step, and adjusting a mixing ratio of the inks in accordance with measurement signals obtained during the measuring step.

8. An ink-jet printing method, of the type in which half-tone dots are produced by selectively applying ink to a recording carrier or print transfer material, the method which comprises the steps of, before selectively applying ink to a recording carrier or print transfer material, mixing inks of a plurality of colors for a given half-tone dot to be produced, and adjusting a mixed ratio of the inks in accordance with measurement signals from color measurements of preceding ink mixtures.

9. Ink-jet printing method according to claim 8, whereby the adjusting step comprises adjusting a mixed ratio of the inks in accordance with measurement signals from color measurements of preceding incorrect or faulty mixtures.

10. An ink-jet printing method, of the type in which half-tone dots are produced by selectively applying ink to a recording carrier or print transfer material, the method which comprises the steps of, before selectively applying ink to a recording carrier or print transfer material, mixing inks of a plurality of colors for a given half-tone dot to be produced, measuring a color.of the recording carrier or print transfer material, and adjusting a mixed ratio of the inks in accordance with measurement signals obtained in the measuring step.

11. An ink-jet printing method, of the type in which half-tone dots are produced by selectively applying ink to a recording carrier or print transfer material, the method which comprises the steps of, before selectively applying ink to a recording carrier or print transfer material, mixing inks of a plurality of colors for a given half-tone dot to be produced, and adjusting a quantity of inks to be mixed in accordance with the physical properties or characteristics of the recording carrier or print transfer material.

12. Ink-jet printing method according to claim 11, which includes further adjusting the quantity of the inks to be mixed in accordance with measurements of moisture and suction capacity of the recording carrier or the print transfer material.

13. An ink-jet printing method, of the type in which half-tone dots are produced by selectively applying ink to a recording carrier or print transfer material, the method which comprises the steps of, before selectively applying ink to a recording carrier or print transfer material, mixing inks of varying colors together with additives for a given half-tone dot to be produced.

14. Ink-jet printing method according to claim 13, which comprises intermixing the additives in form of at least one substance selected from the group consisting of adhesive agents and hardeners with the inks of varying colors.

15. Ink-jet comprising a device for supplying ink-jet printer comprising a device for supplying ink, an ink-jet generating device connected thereto, said ink-jet generating device having at least one nozzle for selectively applying ink to a recording carrier or a print transferring material and being positionable relative to the recording carrier or the print transferring material, and control means to which said ink-jet generating device is connected, said ink-supplying device having at least one mixing chamber for inks of different colors, said mixing chamber having ink inlet channels thereto formed with respective inlet openings, and respective metering devices for said inlet openings disposed in said ink inlet channels, said metering devices being connected to said control means and being actuatable thereby, and a device connected to said control means for measuring a color of the recording carrier or print transfer material.

16. Ink-jet printer according to claim 15, including an input device for digitized image data, a device for monitoring at least one of ink color and quality, an ink collecting vessel and a deflection device for controlling the ink-jet into said ink collecting vessel, and a device connected with said mixing chamber for removing incorrect ink mixtures from the mixing chamber, said control means being connected to at least one of said input device, said monitoring device, said deflection device, said measuring device and said ink-mixture removing device

17. Ink-jet printer according to claims 16, wherein said monitoring device has ink measuring devices disposed at at least one of said ink inlet channels, said mixing chamber and said recording carrier or print transfer material.

18. Ink-jet printer according to claim 15, wherein said ink-supplying device and said ink-jet generating device are structurally united in a chamber.

19. Ink-jet printer according to claim 15, wherein said mixing chamber is furnished with a homogeneous mixing device.

20. Ink-jet printer according to claim 15, including a connecting channel between said mixing channel and said ink-jet generating device, and a device for introducing a separating medium disposed in said connecting channel.

* * * * *